United States Patent [19]

Rutter et al.

[11] Patent Number: 4,574,559

[45] Date of Patent: Mar. 11, 1986

[54] FLEXIBLE BAG AUTOMATIC FILLING AND CAPPING APPARATUS

[76] Inventors: Christopher C. Rutter, 21063 Cabot Blvd., Hayward, Calif. 94545; Robert G. Pongrass, 122 Ocean St., Woolhara 2025, New South Wales, Australia

[21] Appl. No.: 689,079

[22] Filed: Jan. 4, 1985

[51] Int. Cl.[4] ..... B65B 31/06; B65B 7/28; B67B 1/00

[52] U.S. Cl. ..... 53/266 R; 53/268; 53/300; 53/381 A

[58] Field of Search ..... 53/266 R, 268, 300, 53/381 A, 468, 492

[56] References Cited

U.S. PATENT DOCUMENTS

| | | | |
|---|---|---|---|
| 3,377,775 | 4/1968 | Mattimoe et al. | 53/266 X |
| 3,447,281 | 6/1969 | Buford et al. | 53/300 X |
| 3,516,220 | 6/1970 | Buford et al. | 53/268 X |
| 4,120,134 | 10/1978 | Scholle | 53/268 X |
| 4,250,691 | 2/1981 | Marshall | 53/268 X |
| 4,283,901 | 8/1981 | Schieser et al. | 53/300 X |
| 4,297,929 | 11/1981 | Schieser et al. | 53/300 X |
| 4,363,203 | 12/1982 | Marshall et al. | 53/381 A X |
| 4,363,338 | 12/1982 | Brown | 53/381 A X |
| 4,446,674 | 5/1984 | Inada | 53/381 A X |
| 4,481,753 | 11/1984 | Rutter et al. | 53/300 X |

*Primary Examiner*—Horace M. Culver
*Attorney, Agent, or Firm*—Linval B. Castle

[57] ABSTRACT

An automatic bag filling and capping apparatus includes an input ramp for receiving a continuous web of flexible laminated plastic bags each having a capped tubular filling fitment. A linear drive conveyer engages the leading bag fitment and pushed it along the ramp to a fitment gripper and, at that point, a severing blade separates the leading bag from the continuous web. The separate bag is then passed to a filling position where the fitment is held by side grippers on a three-position elevator, a cap gripper on a shuttle comes in to grasp the cap which is removed when the elevator is lowered. The elevator is then raised to engage the open fitment with a filling tube. When filled, a pair of temporary sealing cups are brought in to pinch the filled flexible bag just below the fitment to seal the bag against the admission of air. The elevator carrying the temporarily sealed bag is lowered, the cap gripper positions the cap over the fitment, the elevator is raised to reapply the cap, and the sealing cups and elevator side grippers are retracted to permit the filled and sealed bag to settle on an output conveyer. An alternate embodiment of the cap gripper permits new caps which may include a dispenser tap and which enter the apparatus on a vibrating conveyer to be placed on a bag fitment previously supplied without a cap.

19 Claims, 13 Drawing Figures

FIG. 7
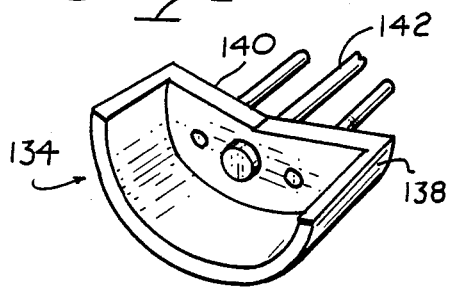
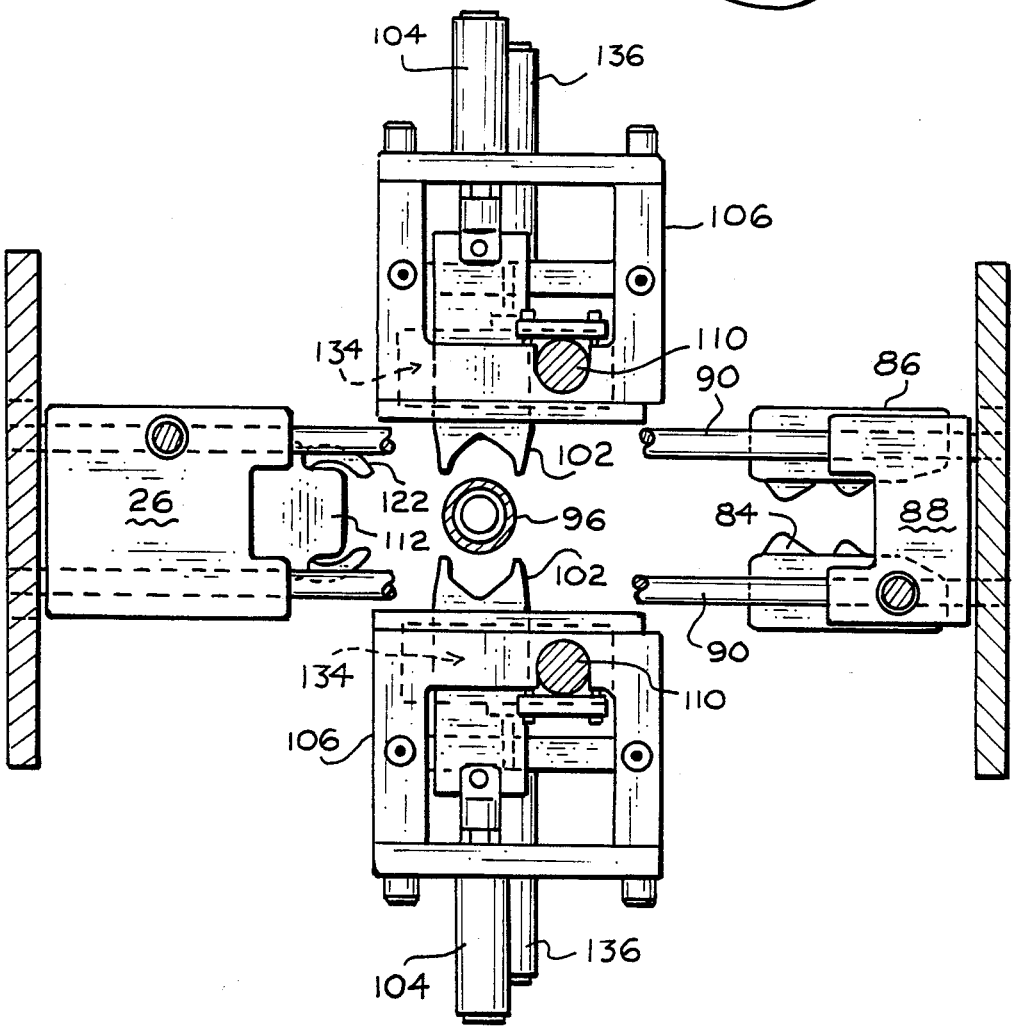
FIG. 6

FLEXIBLE BAG AUTOMATIC FILLING AND CAPPING APPARATUS

BRIEF SUMMARY OF THE INVENTION

This invention relates to automatic packaging machinery and in particular to an apparatus and method for filling flexible bag containers and thereafter sealing them.

The preferred flexible bags used with the automatic packaging apparatus are commercially available thermoplastic laminates, usually formed of two rectangular sheets sealed around the periphery. Firmly attached near one side is a tubular fitment for filling, sealing and ultimately dispensing the contents of the bag. The bag is often used for containing fluids such as wines, juice concentrates, flavoring extracts, or other liquids which may be deleteriously affected by exposure to the atmosphere. When filled, the fluid containing bag is often housed in a relatively rigid supporting container which supports a dispensing tap.

The laminated bags are normally supplied in a continuous web of a hundred or more interconnected bags and may be obtained either with the tubular fitment open for subsequent capping or capped at the manufacturer's plant to prevent possible contamination of the bag interiors during transit and storage. In the preferred embodiment of the apparatus to be described herein, the continuous web of interconnected bags with capped fitments is pushed by a pneumatically driven conveyer arm into a bag fitment escapement which aligns perforations between adjacent bags in the web with a bursting station where the web is separated into individual bags. A bag shuttle then advances the leading separated bag into a filling and capping station where the fitment cap is removed, the bag is filled and the fitment cap is reapplied. In an alternate embodiment, uncapped bags are passed from the fitment escapement into the filling and capping station where, after filling and removal of air from the bag, new caps that preferably incorporate a fluid dispensing tap enter the filling and sealing station on a second conveyer and are applied automatically to the bag fitment.

An elevator mechanism at the filling and capping station grasps the fitment of an empty bag introduced into the station by the bag gripper shuttle with jaws that enter from the side to engage the tubular fitment between the annular rings thereon. The bag gripper shuttle is then withdrawn to pick up the next bag. The conveyer arm is then withdrawn to pick up the next empty bag while, in the decapping-recapping embodiment, a cap shuttle moves in to the midpoint to grasp the arcuate ring on the fitment cap. While only three vertical elevator positions are generally required for operation of the system, some applications require four positions; hence the elevator mechanism is actuated by a pneumatic four-station cylinder comprised of back-to-back pneumatic cylinders with the piston of one cylinder having a longer stroke so that the selective activation one or both of the two cylinders will produce four elevator positions. While the fitment cap is held by the cap jaws on the cap shuttle, the fitment gripping jaw assembly on the elevator mechanism is lowered to pull the cap from the fitment. The cap shuttle then moves aside so that the elevator mechanism holding the bag by its fitment can be raised to its uppermost position so that the bag fitment will engage the filling spout where, after first applying a vacuum to remove all air, the bag is filled with a predetermined volume of a product. The filling ceases and semicircular bag closing cups on a pneumatic assembly mounted on the elevator mechanism are automatically brought in from each side to squeeze the filled bag just under the attached fitment to temporarily seal the bag against the admission of air until the bag can be capped. While the bag is temporarily sealed by the bag closing cups, the elevator is moved down to its lowest position, the cap shuttle moves in to position the cap over the fitment opening and the elevator is raised to its mid-position to therby insert the cap. The closing cups are then retracted and the filled bag is released upon an output conveyer.

All mechanical operations are performed pneumatically. A preprogrammed microprocessor controls the various steps and responds to inputs from various sensors that may, for example, indicate the position of a tubular fitment or the gripping jaw elevator and directs the next step such as the grasping of the cap and lifting it from the tubular fitment. It should be understood that mechanical and pneumatic functions such as these are performed by many types of control systems well known in the art and that other control systems may be employed in the automatic packaging apparatus described herein.

BRIEF DESCRIPTION OF THE DRAWINGS

In the drawings which illustrate the preferred embodiment of the invention:

FIG. 6 is a plan view of the various components in the filling and capping station taken along the lines 6—6 of FIG. 5;

FIG. 7 is a perspective view of one of the two bag closure cups in the filling and capping station;

DETAILED DESCRIPTION OF THE PREFERRED EMBODIMENT

Figure 1:
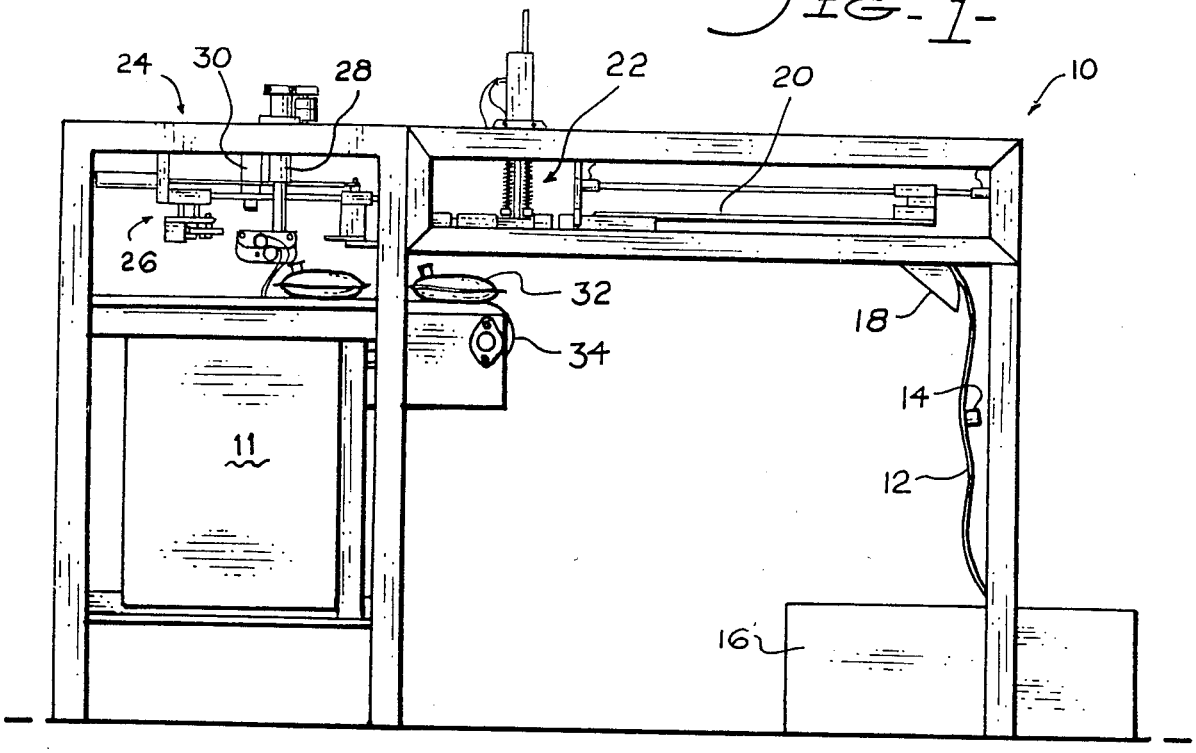
FIG. 1 is a side elevational view of the automatic filling and capping machine and illustrates the positions of the various components thereof.

FIG. 1 is an elevation view of the automatic filling and capping machine 10 and the placement of the various components thereon. All functions performed by the machine are under the control of a preprogrammed digital processor in an enclosure 11. The processor responds to inputs from sensors positioned at various positions on the machine and controls the operation of pneumatic pistons or controllers that operate the various mechanical components of the machine. Digital processing is well known in the art and the particular control system employed herein is not to be considered a part of the invention.

Figure 2:
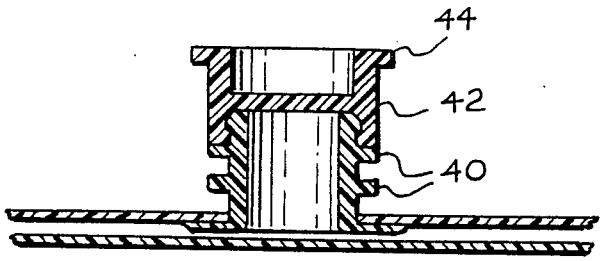
FIG. 2 is a sectional view of a portion of a typical flexible bag and the capped fitment attached thereto.
Figure 3:
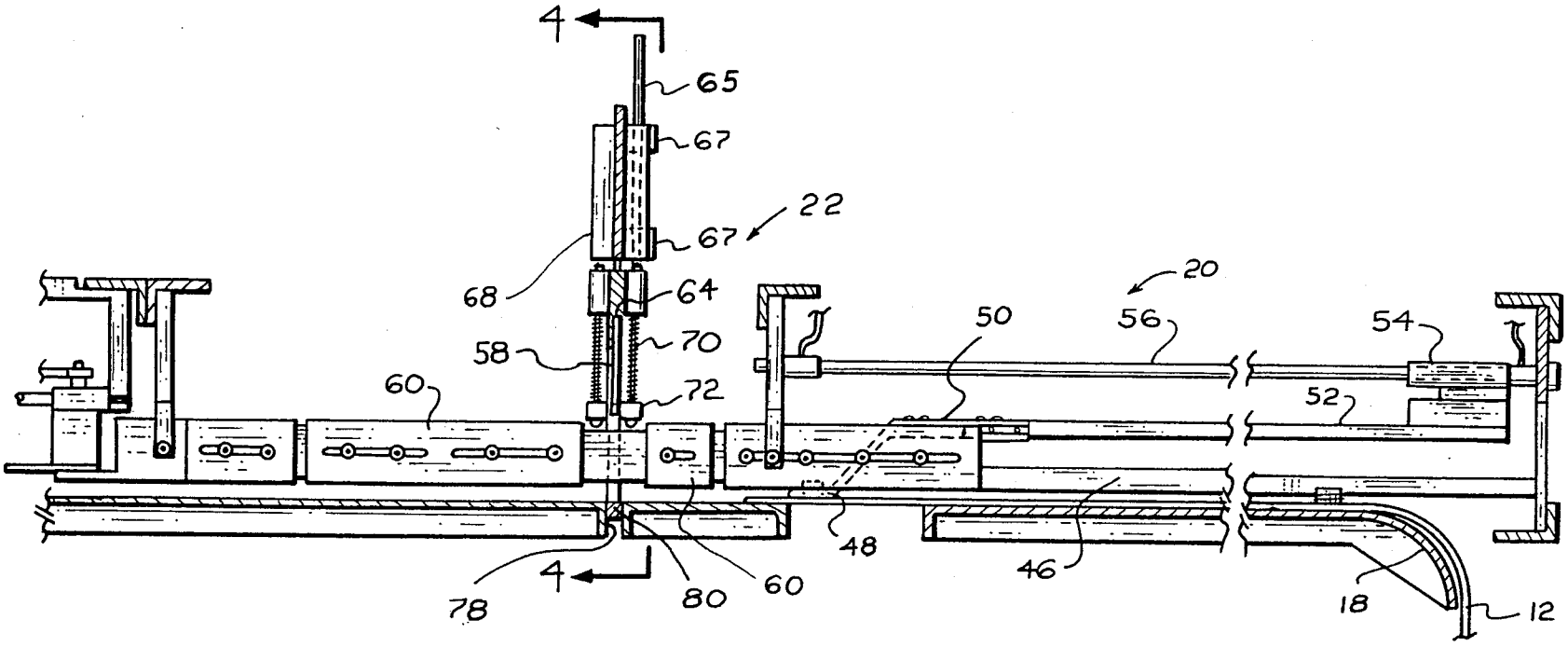
FIG. 3 is a side elevational view illustrating the details of the bag feeding and web bursting mechanisms.
Figure 4:
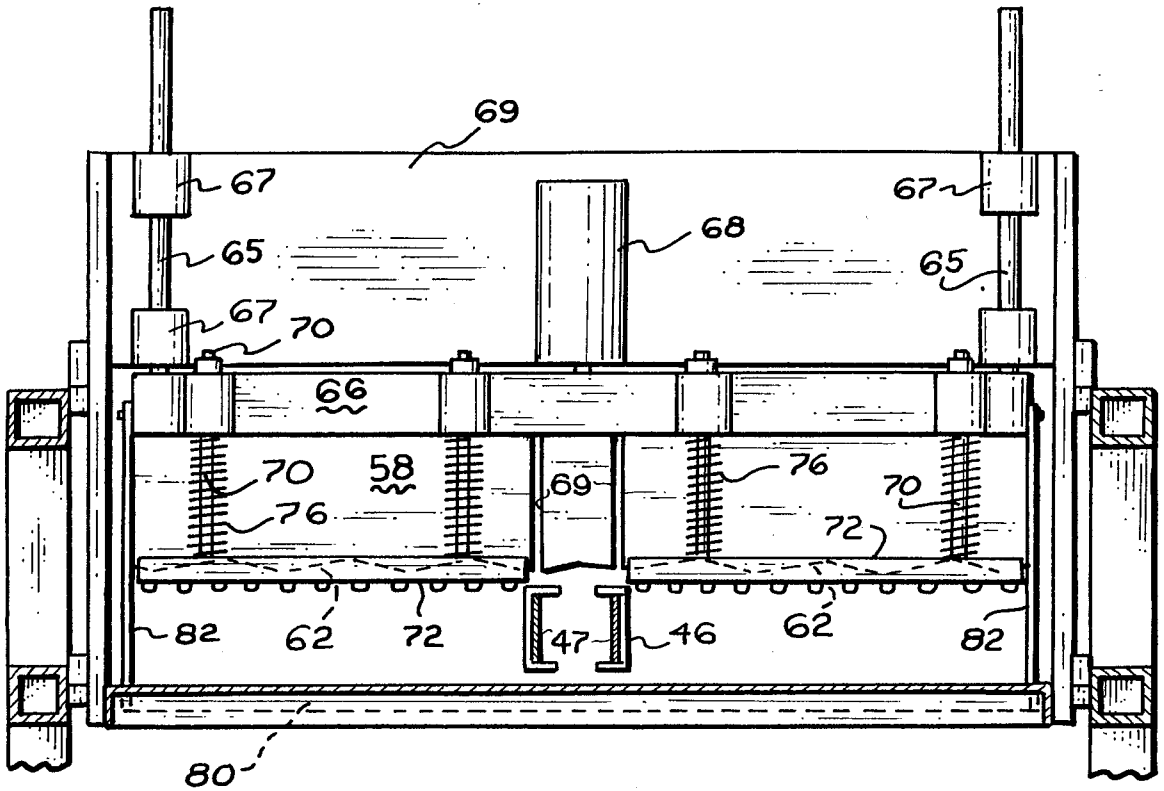
FIG. 4 is an elevational view of the web bursting mechanism taken along the lines 4—4 of FIG. 3.

As shown in FIG. 1, a continuous web of laminated thermoplastic flexible bags 12, separated by perforations in the web, and each equipped with a fitment 14, such as shown in FIG. 2, is fed from its packing container 16 onto a curved input ramp 18 and into a pneumatically driven linear conveyer 20 that engages the bag fitment and transfers the fitment into a fitment escapement which aligns the perforations between the separate bags in the web with the bursting station 22, shown in detail in FIGS. 3 and 4 where the web is severed at the perforations into individual bags. The linear conveyer 20 then returns to pick up the next bag in the web while a bag shuttle carrying the fitment escapement transfers the first separated bag into the filling and capping station 24 as shown in detail in FIGS. 5 and 6.

Figure 9:
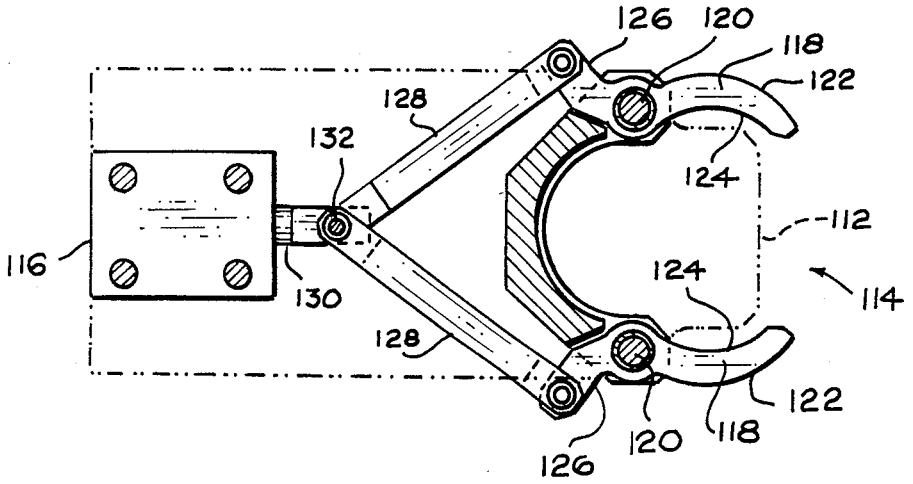
FIG. 9 is a plan view of the cap assembly of FIG. 8 taken along the lines 9—9 of FIG. 8.
Figure 8:
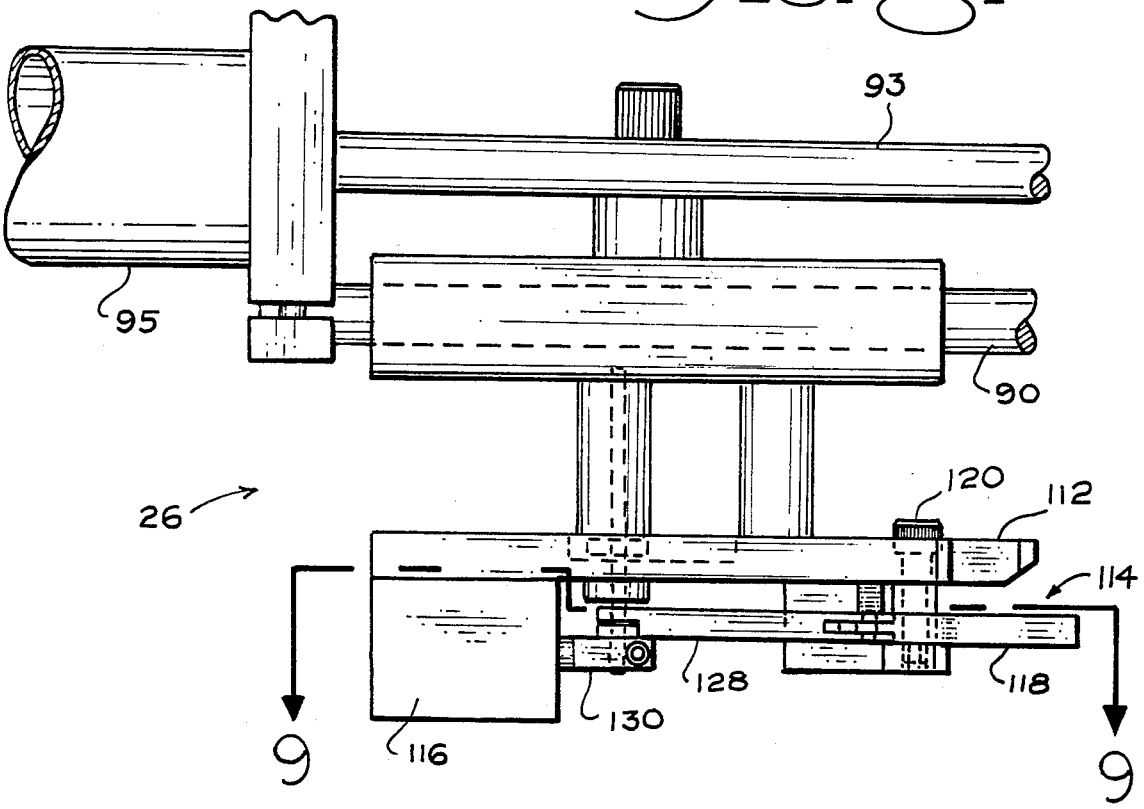
FIG. 8 is an elevational view illustrating the details of the fitment cap assembly in the decapper/recapper embodiment taken along the lines 8—8 of FIG. 5.

If the flexible bags 12 were the type supplied with caps on the fitments, the bag in the filling and capping station 24 is decapped by the assembly 26 illustrated in detail in FIGS. 8 and 9, raised by a multi-station elevator 28 so that the fitment engages a vacuum and filling tube 30 through which is first applied a vacuum to completely evacuate the flexible bag which is then filled by a metered amount. While the bag fitment is still connected to the filling tube, bag closure cups carried by the elevator 28 are drawn in to close off the filled bag immediately under the fitment to thereby prevent the entrance of air and loss of the bag contents until the fitment is closed by the permanent fitment cap. One of the two bag closer cups is shown in detail in the perspective drawing of FIG. 7. The elevator supporting the filled and temporarily sealed bag is then lowered and the capper assembly which removed the cap now positions the cap over the fitment opening, the elevator is then raised to its mid-position to thereby insert the cap on the fitment, and the bag sealing cups and elevator grippers are then separated to release the filled bag 32 upon an output conveyer 34.

Figure 10:
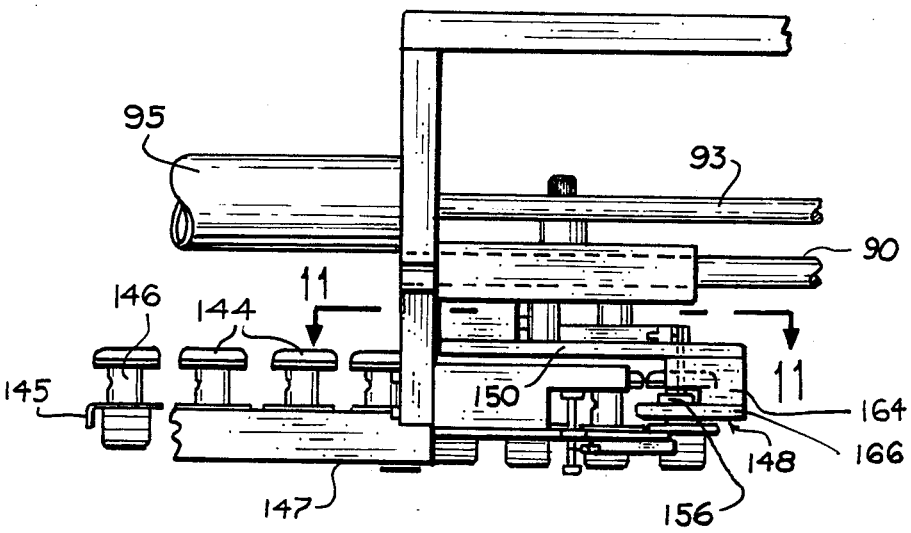
FIG. 10 is a side elevational view of the fitment capper for applying new caps to previously uncapped filled bags.
Figure 11:
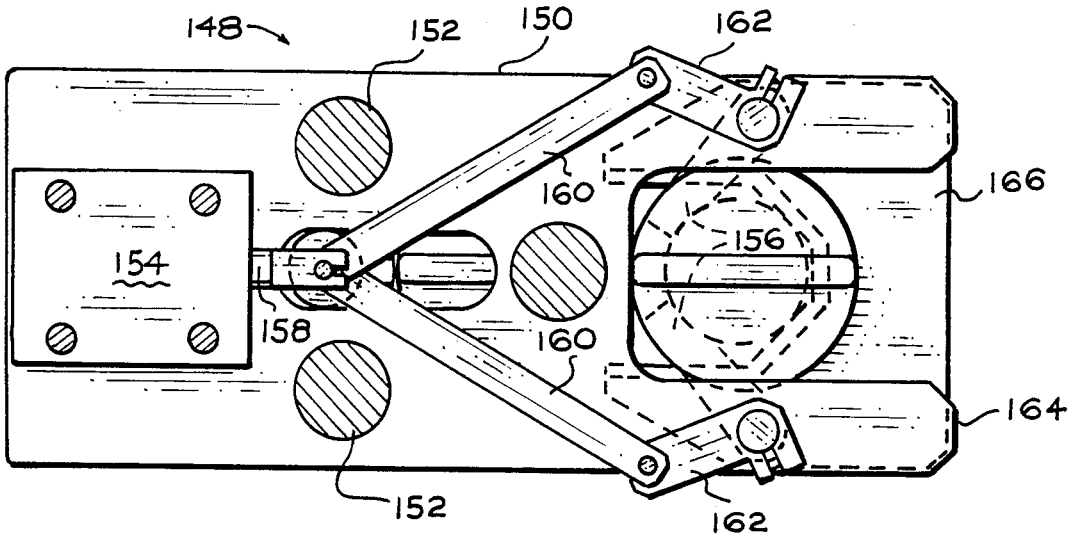
FIG. 11 is a plan view of the capper taken along the lines 11—11 of FIG. 10.

If the flexible bag is the type provided without a fitment cap, the bag with uncapped fitment goes through substantially the same process of conveying to the filling and capping station, grasping the fitment by jaws on the elevator and, without going through the uncapping step, the bag fitment is raised into contact with the evacuating and filling tube. When filled, the bag sealing cups seal the bag immediately below the fitment, the elevator drops to its lowest position where a new cap, that may include a dispenser valve and which has entered by a conveyer (not shown) into a capper assembly shown in detail in FIGS. 10 and 11, is positioned over the fitment so that, upon raising of the elevator to its mid-position, the new cap is applied.

FIG. 2 is a sectional view of a typical fitment 36 attached to one side of a laminated thermoplastic bag 38. Fitments, such as fitment 36 are normally a heavy tubular pliable plastic and are formed with two or more annular rings 40 in addition to a tapered end ring to which is attached a pliable plastic fitment cap 42. The fitment cap also has an annular end ring 44 of larger diameter. The annular rings are provided so that the various conveyers, fitment jaws, and cap jaws can easily and firmly grasp the fitment and cap for removal of the cap and subsequent cap replacement and the temporary supporting of the bag.

FIG. 3 is an elevational view illustrating in detail the linear conveyer 20 and web bursting station 22 of FIG. 1. The web 12 of bags from its supply container 16 is initially fed by hand into the station until the fitment 14 on the leading bag enters the centrally located guide track 46 best illustrated in FIG. 4. When sufficiently within the track 46, the end of a push rod 48 engages the upward extending fitment. A thin resilient spring member 50 interconnects the push rod with the first end of a long conveyer arm 52 that is connected at the second end to a non-magnetic linear bearing housing 54 slideably mounted on a long non-magnetic tube 56. A magnet within the bearing housing 54 cooperates with a magnetic piston within the tube 56 which magnet is linearly moveable in a selected direction within the tube by the application of pneumatic pressure to either end thereof. Thus, the push rod 48 and bag fitments are moved longitudinally by operation of an air driven piston to thereby convey the web of interconnected bags of the bursting station. When the push rod is subsequently withdrawn the thin spring member 50 permits the push rod to ride over the top of the next fitment and drop behind it for engagement therewith.

The web bursting mechanism is illustrated in detail in FIG. 3 and 4. As previously noted, the web 12 is continuous but is perforated between each adjacent bag. The individual bags in any particular batch or shipment may differ in width and length dimensions from other batches. Since the conveyer arm 52 can move only a fixed distance determined by the stroke of the magnetically coupled pneumatic piston 54, 56, it is important that, to accomodate bags of various lengths, the longitudinal position of the bursting assembly blade 58 be variable as shown by the slotted structural members 60 clamped to the guide track 46 and to frame members.

The web burster includes a blade 58 that is not sharp but which has a "cutting" edge 62 that is saw toothed across the length of the blade to engage and separate the perforations in the web as shown in FIG. 4. The blade 58 is about four inches in depth and is attached along each side across its top edge 64 to a member 66 mounted on shafts 65 for vertical movement in linear bearings 67 that are attached to a vertical stationary structural plate 69 adjustably attached to the frame of the automatic filling and capping machine. It will be noted that the center area of the blade 58 has two vertical slots 69 to thereby permit it to clear the vertical side walls 47 of the guide track. The member 66 is coupled at its center to a vertically moveable pneumatic piston assembly 68 which, when activated downward, will force the saw toothed cutting edge 62 of the blade 58 into the web perforations to separate the bags. Vertical through holes on the top edge of member 66 on both sides of the blade 58 slideably support vertical shafts 70 which are capped on their top ends to prevent sliding through the vertical holes and which, on their bottom ends, support cross bars 72 which preferably have rubber buttons 74 cemented to their lower surfaces to hold the plastic bag web and to prevent its slipping while the perforations are being separated by the blade 58. The foot members or cross bars 72 are forcably separated from the top member 66 by coil springs 76 around each shaft 70 so that the bag web will be tightly held when the blade 58 is lowered by action of the pneumatic piston assembly 68.

When lowered to sever the web, the saw toothed blade 58 must enter a narrow slot 78 across the floor of the bursting station in order to cleanly cut through the perforations. Such a slot would normally catch the leading edge of the web following the severing of the front bag. To prevent this, the slot 78 is filled with a small square vertically moveable bar 80 which, as shown in FIG. 4, is connected through vertical members 82 to the top cross member 66. Therefore, when the blade 58 is lowered, the square bar 80 is correspondingly lowered to permit the blade to enter the cross slot 78.

Figure 5:
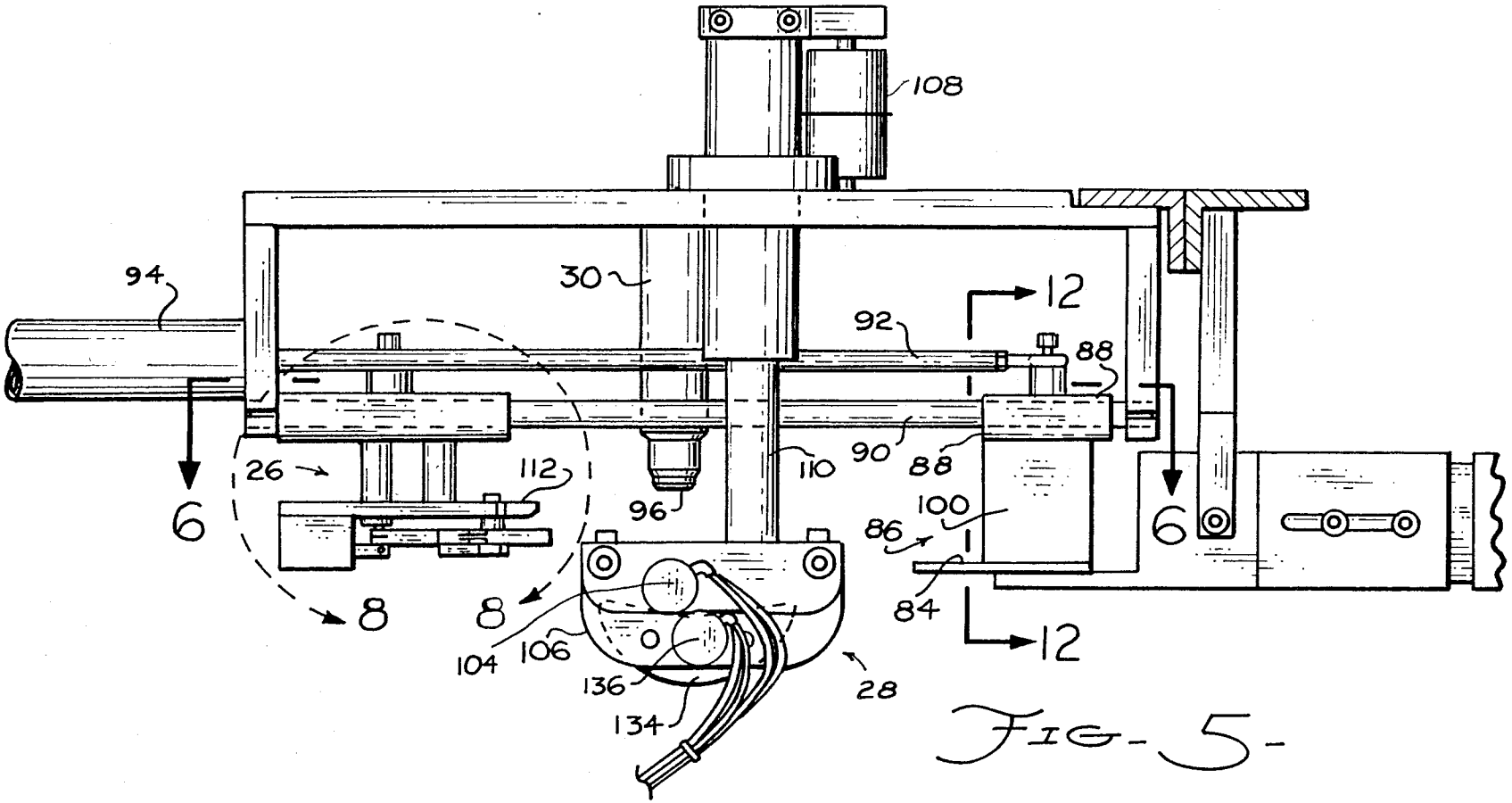
FIG. 5 is a side elevational view illustrating the details of the flexible bag filling and capping station.
Figure 12:
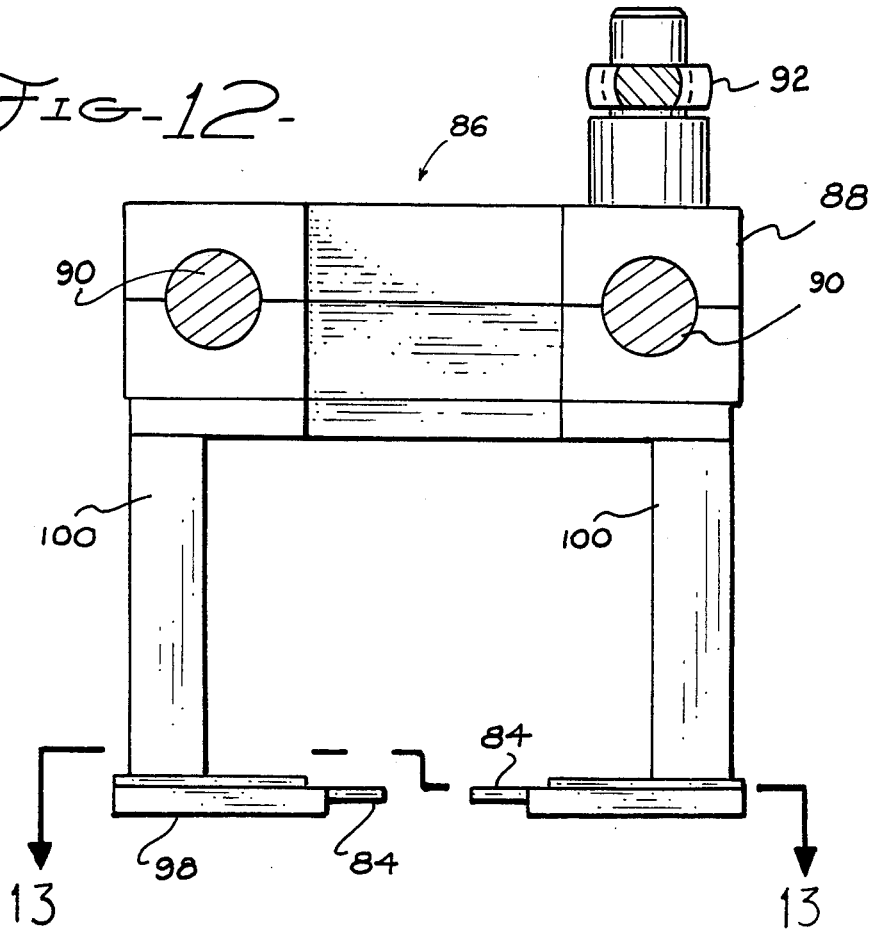
FIG. 12 is an elevational view of the empty bag gripper shuttle assembly taken along the lines 12—12 of FIG. 5.
Figure 13:
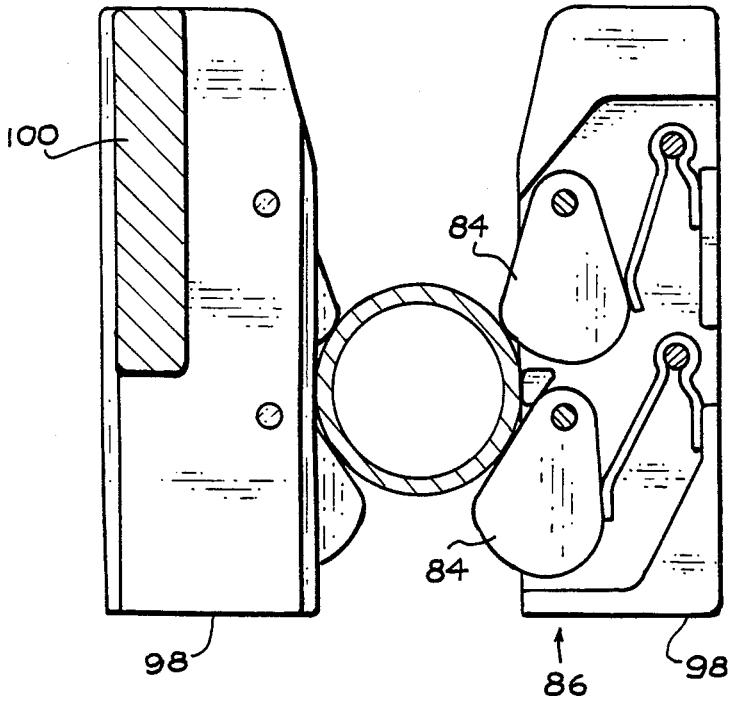
FIG. 13 is a plan view of the empty bag gripper shuttle taken along the lines 13—13 of FIG. 12 and illustrates the details of the fitment escapement therein.

When the longitudinal movement of the conveyer arm 52 has moved the leading container into proper position for it severing in the bursting station, it will have moved the container fitment into the fitment escapement of the filling and capping station and specifically into engagement with pawls 84 on a bag shuttle 86 shown in FIGS. 5 and 6 and in greater detail in FIGS. 12 and 13. As best shown in the end elevational view of FIG. 12, the bag gripper shuttle 86 includes a cross member 88 which is slideably coupled to two separated longitudinal parallel bars 90 which span the length of the filling and capping station as shown in FIG. 5. Attached to the top surface of the cross member 88 is an actuator bar 92 that extends over the length of the filling station and to the piston of a pneumatic actuator 94 that operates to slide the bag gripper shuttle 86 from the position shown in FIG. 5 to a point at which the fitment it carries is centered under the evacuating and filling tube 30.

As best shown in the plan view of FIG. 13, the bag gripper shuttle 86 includes four pawls two of which are aligned on each side of the longitudinal center line of the shuttle. The pawls 84 are generally oval in shape, are pivotally connected near one end within recesses in the surfaces of one of two spaced horizontal members 98 that are connected by side plates 100 to the longitudinally sliding cross member 88, and are spring loaded to force each pawl horizontally toward the center line. The generally oval shape and the spring loaded end pivoting of the pawls 84 operate to resist removal of a fitment toward the bursting station and to permit easy entrance of a bag fitment into the bag gripper shuttle 86 where each of the four pawls grasp the fitment in one of the grooves formed between the annular rings thereon so that the fitment lies in the center of the pawls as shown in FIG. 13.

When the fitment is properly centered between the four pawls 84 of the bag gripper shuttle 86, the pneumatic cylinder 94 of FIG. 5 draws the rod 92 and bag gripper shuttle 86 to the left and to the point at which the center of the bag fitment is centered under the filling tube 30. When thus positioned, a pair of elevator grippers 102 shown in the plan view of FIG. 6 are drawn in from the side by cylinders 104 to engage a second or empty groove between the annular rings on the fitment. When thus grasped by the elevator grippers 102, the bag gripper shuttle 86 is withdrawn toward the bursting station to accept the next bag fitment pushed along by the conveyer arm 52.

Each of the two elevator grippers 102 are mounted on an assembly 106 near the lower end of a four-positioned elevator 28, as shown in FIG. 5 and the plan view of FIG. 6. The elevator is vertically moved by a pair of back-to-back pneumatic cylinders 108, one of which has a longer stroke than the other so that the selective activation of either one or both of the cylinders can produce four available elevator positions that may be required in some applications. In the embodiment described herein, only three elevator positions are required. The cylinders 108 are coupled to a cross member to which is connected a pair of spaced vertical elevator shafts 110 which operate together to raise and lower the two assemblies 106 to a predetermined one of three vertical positions.

The elevator is lowered to its lowest position after the elevator grippers 102 are moved inward to engage an annular groove in a bag fitment. In the embodiment wherein each fitment has been previously capped, a cap gripper shuttle 26 moves toward the center to grasp the periphery of the fitment cap immediately below its annular end ring.

The cap gripper shuttle 26, illustrated in detail in FIG. 8 and 9, is slideably mounted to the two parallel bars 90 and is moved by an actuator rod 93 and a pneumatic actuator 95. As shown in FIGS. 8 and 9, the shuttle includes a solid horizontal plate 112 which serves both as a base for attachment of a cap gripper 114 and its pneumatic actuator 116, and also as cap press that forces the cap on the fitment during recapping operations. The cap gripper 114 comprises a pair of generally L shaped gripping arms 118 in a horizontal plane, each gripper being connected at pivots 120 to the plate 112 at the junction of the legs of the L. One leg 122 on each gripper arm extends outward from the pivot 120 and is formed with an inward arcuate section 124 suitable for gripping the periphery of a bag fitment cap. Pivotally connected to the ends of the short legs 126 of the gripping arms 118 are the first ends of bars 128 the second ends of which are coupled together and to the end of a pneumatic actuator arm 130 at a pivot 132. The actuator arm 130 is normally retracted so that the cap gripper arms 118 are open. When the gripper shuttle is drawn in to grasp a fitment cap, the actuator 116 drives its piston shaft 130 toward the gripper arms 118 thus forcing the bars 128 to close the gripper arms 118 and grasp the fitment cap. It will be noted in FIG. 8 that the top surface of the cap grasped by the arms 118 will be beneath the plate 112 which, during recapping, operates to force down on the cap.

With the fitment cap firmly held by the cap gripper shuttle 26 and the elevator grippers 102 engaging the grooves in the fitment, the elevator is lowered from its center position to pull the cap from the fitment. The shuttle 26 then moves away and the elevator is raised to its topmost position to force the bag fitment into engagement with the open end 96 of the evacuation and filling tube 30. As previously mentioned the tube 30 and its operation is described and claimed in U.S. Pat. No. 4,360,996, issued Nov. 30, 1982, and operates to first apply a vacuum to the attached bag to withdraw all air and then meter through the filling tube a predetermined volume of fluid after a vacuum of a predetermined level is detected by associated sensors.

When the flow is fluid from the filling tube 30 has stopped, and prior to release of the fitment, the filled bag is sealed against the admission of air and loss of the bag contents by a pair of sealing cups 134 which are mounted to the elevator assembly 106 and which are moveable by pistons 136 to pinch closed the bag just below the fitment. One of the two sealing cups 134 is illustrated in FIG. 7 and is shown to include a semi-circular, smooth plastic shell member 138 open at the bag contacting end and having an opposite end wall 140 to which is connected a pneumatic piston shaft 142. The two sealing cups 134 are thus forced in from each side of the bag fitment to substantially seal off the flexible bag immediately below the fitment.

Once the sealing cups 134 are positioned to seal the filled bag, the elevator is lowered to its bottom position to release the fitment from the filling tube end 96. The cap shuttle, still carrying the previously withdrawn cap, is positioned over the fitment and the elevator is raised to its mid-position to thereby recap the fitment. The sealing cups 134 and the elevator grippers 102 are then withdrawn and the filled and capped bag drops to the output conveyer 34 as shown in FIG. 1.

FIGS. 10 and 11 illustrate a capper assembly employed where flexible bags are provided without fitment caps and new caps entering the filling and capping machine from a separate conveyor are applied to the fitment after the bag has been filled, the sealing cups have sealed the filled bag and the elevator has been lowered to its lowest position. The capper assembly is attached to the same moveable shuttle used for the capper of FIGS. 8 and 9 by merely unbolting one assembly and bolting on the desired capping assembly. Obviously, a change in the controller program is also required.

As shown in the elevational view of FIG. 10, a supply of valved dispensing caps 144, each having a thin flexible circular flange 145 and a dispensing barrel 146, enter and are gently moved along a vibrating linear conveyer 147 from the left where the leading cap is stopped by a light spring clip at a point at which it may be grasped by the arms of the cap gripper 148. FIG. 11 illustrates the cap gripper 148 in greater detail and shows a top plate member 150 which may be connected to the slideable shuttle by bolts 152, and which supports a pneumatic actuator 154 that controls the opening and closing of the cap grasping arms 156. The right end of the plate member 150 has a horseshoe shaped opening to provide clearance for the evacuation and filling tube 30 when the shuttle is moved in to place a cap on a fitment.

As with the cap gripper of FIGS. 8 and 9 the actuator 154 controls the movement of a piston rod 158 that is pivotally coupled to the ends of a pair of rods 160, the opposite ends of which are pivotally coupled to the ends of a pair of L shaped cap grippers 162. The junction of the legs of the L shaped grippers is pivotally coupled to the plate member 150 and the free arms 156 of the grippers 162 firmly engage the external surface of the cap dispensing barrel 146 above the circular flange 145.

Side plates 164 attached to and depending from the side legs of the horseshoe portion of the plate member 150 support a bottom plate 166 that is also horseshoe shaped with the opening facing toward the cap supply conveyer. The bottom plate 166 is separated from the top plate member 150 by an amount at least equal to the thickness of the box flange 145 on a cap so that the flange rests on the top of the bottom plate 166 and the gripper arms 156 securely hold the barrel above the flange. Thus, the gripper arms 156 grasps the cap barrel 146 held by the light spring at the end of the vibrating linear conveyer 147, the capper shuttle moves on the actuator rod 93 to center the cap over a filled bag held by the elevator grippers on the elevator at its bottom position, and the elevator is raised to its mid-position to force the dispensing cap into the bag fitment. The filled bag with the dispensing cap firmly in place is then released by the elevator grippers and drops to the output conveyer.

What is claimed is:

1. Apparatus for filling and capping flexible containers supplied to an input ramp in said apparatus each container having at the leading end thereof an attached tubular fitment extending from a surface thereof, said apparatus including:

conveying means for engaging the tubular fitment of the container and for advancing said fitment a predetermined distance along said ramp and into engagement with a fitment gripper;

a multi-position elevator having at least one vertically moveable shaft adjacent the axis of said ramp;

elevator gripper means coupled to said vertically moveable elevator shaft, said elevator gripper means for grasping the exterior of said fitment for removal thereof from said fitment gripper; and a container filling the tube vertically coaxial with the open tubular fitment held in said elevator gripper means and positioned to engage said fitment upon the raising of said multi-position elevator to its top position.

2. The apparatus claimed in Claim 1 wherein said multi-position elevator includes first and second pneumatic cylinders interconnected in series, said first cylinder having a piston stroke longer than the piston stroke of said second cylinder so that a total of four vertical positions of said elevator are available.

3. The apparatus claimed in Claim 1 further including temporary sealing means mounted on said multi-position elevator, said sealing means being extendible to pinch the filled flexible container below the fitment thereon for the substantial sealing of said container, said sealing means remaining after the removal of said container from the filling tube and until after said container fitment has been capped.

4. The apparatus claimed in Claim 1 wherein said containers are supplied to said input ramp in a continuous web with each container separated from adjacent containers by perforations across said web, and wherein said apparatus further includes container separation means having a moveable web separating blade positioned over the perforations in said container web for severing said web when said conveying means has advanced the fitment of the leading container in said web into engagement with a fitment gripper.

5. The apparatus claimed in claim 4 wherein the tubular fitment at the leading end of a container enters a track guide longitudinally positioned above said ramp and wherein said conveying means includes a longitudinally moveable member having a pivotally mounted end portion that engages the rear of said fitment and pushes said fitment a fixed distance along said track guide.

6. The apparatus claimed in claim 1 wherein said tubular fitment is capped with a removable cap and wherein said apparatus further includes a cap gripper mounted for longitudinal movement into a position under said container filling tube, said cap gripper having arcuate jaws for grasping the removable cap of said fitment, said cap being removed from said fitment by the lowering of said multi-position elevator.

7. The apparatus claimed in claim 6 wherein said flexible container tubular fitment is recapped after filling by lowering said elevator, positioning said cap gripper and cap over the fitment thereon, and raising said elevator.

8. The apparatus claimed in claim 7 further including temporary sealing means mounted on said multi-position elevator for substantially sealing said filled flexible container prior to the removal of said container fitment from said filling tube, said sealing means remaining after such removal, after the lowering of said elevator to a lower position, after the repositioning of said cap by said cap gripper over said fitment, and the raising of said elevator to re-install said cap in said fitment.

9. The apparatus claimed in claim 4 wherein said container separating means is longitudinally adjustable along said ramp to accomodate and sever containers of various lengths.

10. The apparatus claimed in claim 9 wherein said container separating means includes a vertical plate member coupled to a frame member of the apparatus and longitudinally adjustable thereto, said plate member supporting at least one vertical shaft guide member and at least one vertical actuator coupled through shafts to said vertically moveable separating blade, said vertical actuator also coupled by springs to cross bars positioned above said ramp on each side of said blade, the lowering of said bars upon the surface of a container preventing movement of said container during the severing of the contained from said web.

11. The apparatus claimed in claim 10 wherein the lower cutting edge of said separating blade enters a lateral slot formed in said ramp, said slot containing a vertically moveable bar the top surface of which is substantially coplanar with the surface of said ramp, said container separating means including means for lowering said bar upon the lowering of said separating blade.

12. The apparatus claimed in claim 5 wherein said fitment gripper includes a longitudinally moveable shuttle carrying thereon a plurality of pawls aligned with said track guide and on each side of the longitudinal axis thereof, said fitment gripper permitting passage of a fitment only in a direction from said conveying means, said moveable shuttle being pneumatically actuated to convey a fitment from the end of said track guide to a position under said container filling tube.

13. The apparatus claimed in claim 12 wherein said multi-position elevator has at least three vertical stations and includes a vertically moveable pair of shafts positioned on each side of the longitudinal centerline extension of said track guide and intercoupled at the top ends to a vertical actuator, the lower ends of each of said shafts carrying said elevator grippers and said sealing means, each of said elevator grippers comprising an pair of arcuate arms for engaging a portion of the tubular exterior of a fitment, said arms being separately coupled to an actuator for extending toward and retracting said arms from a fitment located between said elevator grippers.

14. The apparatus claimed in claim 13 wherein said temporary sealing means is mounted on said multi-position elevator and comprises a substantially identical pair of cups, each having a substantially semicircular open end facing toward each other and each mounted on a shuttle for movement by an actuator toward and away from each other, said sealing means being actuated together after the filling of a container to force together the side surface of a filled container immediately below the fitment thereon.

15. The apparatus claimed in claim 6 wherein said cap gripper is mounted on a longitudinally moveable shuttle entering toward a tubular fitment from a side opposite that of said fitment gripper.

16. The apparatus claimed in claim 15 wherein said cap gripper is removable from its moveable shuttle for replacement by a new cap gripper, said new cap gripper having actuator operable jaws that grasp new caps from the end of a linear vibrating conveyer for placement on the fitment of a filled container.

17. The apparatus claimed in claim 16 wherein said containers are supplied to said input ramp in a continuous web with each container separated from adjacent containers in said web by perforations across said web, said apparatus further including bag separation means adjustably positioned along said ramp for separating the leading container in said web upon the gripping of the fitment of said separated leading container by said fitment gripper.

18. In an apparatus for filling a flexible fluid container through a filling tube removeably attachable to a tubular filling fitment on said container, temporary sealing means for closing and substantially sealing said filled contained prior to the removal of said fitment from said filling tube for substantially preventing the admission of air and loss of container contents pending the permanent sealing of the fitment thereon, said temporary sealing means comprising:

first and second actuator means positioned below and on each side of the axis of said filling tube, each of said actuator means including a shaft having an end moveable along an axis substantially perpendicular to said filling tube axis toward and from said filling tube axis;

first and second sealing cups each having a first end coupled to the end of one of said shafts, the second end of each of said cups having a smooth open arcuate end surface which mates with the open end surface of the other cup when brought together by said shafts, said second ends being positionable immediately under said container fitment; and control means for engaging said first and second actuator means to force together the smooth open end surfaces of said sealing cups to thereby pinch together the filled container below its fitment for the temporary sealing thereof.

19. The temporary sealing means claimed in claim 18 wherein said first and second actuator means are pneumatic pistons, each on a vertically moveable multi-position elevator assembly that includes a pneumatically extendable fitment gripper for securing a tubular filling fitment against the filling tube.

* * * * *